US007396078B2

(12) United States Patent
Weber et al.

(10) Patent No.: US 7,396,078 B2
(45) Date of Patent: Jul. 8, 2008

(54) MUSIC POSTURE CHAIR

(75) Inventors: Patrick H. Weber, Owatonna, MN (US); Kenneth E. Jacobson, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 482 days.

(21) Appl. No.: 10/773,094

(22) Filed: Feb. 5, 2004

(65) Prior Publication Data

US 2005/0173954 A1 Aug. 11, 2005

(51) Int. Cl.
*A47C 3/00* (2006.01)
*A47C 3/04* (2006.01)

(52) U.S. Cl. ..... 297/285; 297/239; 297/354.1; 297/452.15

(58) Field of Classification Search ..... 297/285, 297/291, 354.1, 354.11, 452.21, 239, 452.15, 297/452.14
See application file for complete search history.

(56) References Cited

U.S. PATENT DOCUMENTS

| | | | |
|---|---|---|---|
| 483,265 | A | 9/1892 | Schindler |
| 623,985 | A | 5/1899 | Coffman |
| 633,087 | A | 9/1899 | Johnson |
| 1,516,811 | A | 11/1924 | Edwards |
| 1,583,491 | A | 5/1926 | Rastetter |
| 1,716,871 | A | 6/1929 | Weldon |
| 1,735,921 | A | 11/1929 | Franzosa |
| 1,917,264 | A | 7/1933 | Kellogg |
| 1,938,879 | A | 12/1933 | Waggoner et al. |
| D101,404 | S | 9/1936 | Salomon |
| D110,545 | S | 7/1938 | Hickerson |
| 2,221,268 | A | 11/1940 | Sears |
| 2,380,102 | A | 7/1945 | Farmer |
| 2,542,366 | A | 2/1951 | Scott |
| 2,646,839 | A | 7/1953 | Hillman |
| 2,657,560 | A | 8/1953 | Huebruer |
| 2,666,478 | A | 1/1954 | Shwayder |
| 2,729,275 | A | 1/1956 | Morgan et al. |
| D178,287 | S | 7/1956 | Hamilton et al. |
| 2,845,998 | A | 8/1958 | Estabrook et al. |
| D186,505 | S | 11/1959 | King et al. |
| 2,970,638 | A | 2/1961 | Wockenfuss |
| 3,081,129 | A | 3/1963 | Ridder |
| 3,111,344 | A | 11/1963 | Hoven et al. |
| 3,159,428 | A | 12/1964 | Schier |

(Continued)

FOREIGN PATENT DOCUMENTS

| | | |
|---|---|---|
| DE | 355330 | 6/1922 |

(Continued)

OTHER PUBLICATIONS

Wenger Technical Sheet, "Student Chair," Feb. 1994, 1 page.

(Continued)

*Primary Examiner*—Anthony D. Barfield
(74) *Attorney, Agent, or Firm*—Patterson, Thuente, Skaar & Christensen, P.A.

(57) ABSTRACT

A musician's chair that enhances the musician's posture when performing vocal or wind instruments. The music posture chair includes a seat and back that are mounted on a frame with respect to a floor to not only enhance diaphragmatic breathing of the musician but also to enhance the comfort of the musician.

29 Claims, 14 Drawing Sheets

U.S. PATENT DOCUMENTS 3,220,771 A 11/1965 Doss, Sr.
D209,960 S 1/1968 Rogers
3,376,070 A 4/1968 Johnson
3,393,012 A 7/1968 Chancellor, Jr.
3,446,532 A 5/1969 Cramer
3,503,649 A 3/1970 Johnson
D218,419 S 8/1970 Nightingale
3,527,498 A 9/1970 Werner
3,708,202 A 1/1973 Barecki et al.
3,740,096 A 6/1973 Bridger
D227,833 S 7/1973 Olson
3,749,442 A 7/1973 Berg et al.
D230,790 S 3/1974 Luebke
3,890,004 A 6/1975 Rail
3,982,785 A 9/1976 Ambasz
3,982,786 A 9/1976 Burgin et al.
3,989,297 A 11/1976 Kerstholt
D243,909 S 4/1977 Gabourie
D244,812 S 6/1977 Buhk
4,032,190 A 6/1977 Muller-Deisig et al.
4,046,422 A 9/1977 Ambasz
4,047,757 A 9/1977 Eames et al.
4,076,308 A 2/1978 Slabon et al.
4,084,850 A 4/1978 Ambasz
4,238,097 A 12/1980 Clausen et al.
4,240,663 A 12/1980 Locher
4,306,750 A 12/1981 Wenger et al.
D264,779 S 6/1982 Wenger et al.
4,333,683 A 6/1982 Ambasz
4,359,243 A 11/1982 Crutcher
4,364,605 A 12/1982 Meiller
4,367,897 A 1/1983 Cousins
4,403,356 A 9/1983 Urai
4,418,958 A * 12/1983 Watkin ..... 297/452.15 X
4,484,778 A 11/1984 Cousins et al.
4,489,982 A 12/1984 Morrow
4,522,447 A 6/1985 Snyder et al.
4,552,404 A 11/1985 Congleton
4,588,229 A 5/1986 Jay
4,603,904 A 8/1986 Tolleson
4,607,882 A 8/1986 Opsvik
D288,265 S 2/1987 Meyer
D289,708 S 5/1987 Rykken
4,668,015 A 5/1987 Kjersem
D290,070 S 6/1987 Lange
4,671,570 A 6/1987 Hockenberry et al.
D290,789 S 7/1987 Lange
D295,588 S 5/1988 Heitlinger et al.
D297,890 S 10/1988 Hockenberry et al.
4,781,417 A 11/1988 Shipman
4,783,121 A 11/1988 Luyk et al.
4,824,174 A 4/1989 Dunn, Sr.
4,832,408 A 5/1989 Bertsch et al.
4,834,458 A 5/1989 Izumida et al.
4,850,643 A 7/1989 Rollman
4,866,820 A 9/1989 Hassmann
4,880,276 A 11/1989 Shovar
D307,221 S 4/1990 Mudge
4,953,913 A 9/1990 Graebe
4,981,326 A 1/1991 Heidmann
D315,836 S 4/1991 Kaiser
5,018,790 A 5/1991 Jay
5,035,466 A 7/1991 Mathews et al.
D323,943 S 2/1992 Piretti
5,123,699 A 6/1992 Warburton
D328,395 S 8/1992 Neuser
D328,530 S 8/1992 Pomeroy
5,163,737 A 11/1992 Navach et al.
D331,668 S 12/1992 van de Ven
5,183,314 A 2/1993 Lorbiecki
D333,733 S 3/1993 Sammons
D334,294 S 3/1993 Grosfillex
D339,004 S 9/1993 Grosfillex
5,294,181 A 3/1994 Rose et al.
5,317,773 A 6/1994 Graebe
5,333,933 A 8/1994 Urai et al.
D352,185 S 11/1994 Pagnon et al.
D352,614 S 11/1994 Adams
5,370,444 A 12/1994 Stulik
5,395,162 A 3/1995 Jay et al.
5,398,996 A 3/1995 Steiner
D361,900 S 9/1995 van den Heuvel
5,520,438 A 5/1996 Stulik
5,522,106 A 6/1996 Harrison et al.
5,556,163 A 9/1996 Rogers et al.
5,575,534 A 11/1996 Yu
D376,487 S 12/1996 Cretcher
5,580,128 A 12/1996 Johnson et al.
5,605,379 A 2/1997 Weiss
5,630,240 A 5/1997 Matsuoka et al.
5,630,648 A 5/1997 Allard et al.
5,697,673 A * 12/1997 Favaretto ..... 297/301.1 X
D390,713 S 2/1998 Chen
5,735,575 A 4/1998 Harza
D394,166 S 5/1998 Rossman et al.
5,755,488 A 5/1998 Beda et al.
5,755,490 A 5/1998 Lamart
5,839,782 A 11/1998 Kashiwamura et al.
5,887,947 A 3/1999 Chi
D411,772 S 7/1999 Piretti
5,918,334 A 7/1999 Laidlaw
D420,821 S 2/2000 Barile et al.
6,027,168 A 2/2000 Crossman et al.
6,027,169 A 2/2000 Roslund, Jr.
6,053,574 A 4/2000 Opsvik
D426,394 S 6/2000 Tseng
6,099,076 A 8/2000 Nagel et al.
6,123,390 A 9/2000 Greenwald
D431,385 S 10/2000 Barile et al.
D431,725 S 10/2000 Barile et al.
6,135,556 A 10/2000 Chu et al.
D433,829 S 11/2000 Barile et al.
D433,830 S 11/2000 Barile et al.
D433,836 S 11/2000 Barile
D437,124 S 2/2001 Kemnitzer
D437,139 S 2/2001 Beck
6,193,313 B1 2/2001 Jonsson
D439,069 S 3/2001 Turner et al.
D439,070 S 3/2001 Turner et al.
6,203,107 B1 3/2001 Jonsson
6,209,159 B1 4/2001 Murphy
D441,976 S 5/2001 Cramer
D443,995 S 6/2001 Caruso et al.
6,279,998 B1 8/2001 Chu et al.
D447,643 S 9/2001 Zemp
D448,190 S 9/2001 Chang
6,293,625 B1 9/2001 Dixon
D453,634 S 2/2002 Durbino
6,345,863 B1 2/2002 Laws et al.
D454,716 S 3/2002 Tseng
D455,571 S 4/2002 Van De Riet
D456,164 S 4/2002 Vanderiet
6,370,716 B1 4/2002 Wilkinson
6,371,562 B1 4/2002 Yoshimura et al.
D457,007 S 5/2002 Pearce
D458,467 S 6/2002 Starck
6,398,310 B1 6/2002 Seeliger
D459,604 S 7/2002 Piretti
D461,064 S 8/2002 Fogderud
D464,209 S 10/2002 Piretti
D464,494 S 10/2002 Gasca
6,481,795 B1 11/2002 Pettibon
D466,712 S 12/2002 Haney et al.
6,502,263 B1 1/2003 Rowley et al.

| | | | |
|---|---|---|---|
| D469,621 | S | 2/2003 | Kita |
| D469,969 | S | 2/2003 | Glass et al. |
| D469,971 | S | 2/2003 | Piretti |
| 6,513,222 | B2 | 2/2003 | Von Her et al. |
| 6,543,842 | B2 | 4/2003 | Haney |

FOREIGN PATENT DOCUMENTS

| | | |
|---|---|---|
| DE | 2030095 | 6/1970 |
| DE | 2651843 | 11/1976 |
| GB | 2098471 | 11/1982 |

OTHER PUBLICATIONS

Artcobell, "Photos Music Chair," http://www.artcobell.com/Uniflex%20Unisled&20Chairs/photos_music_chair.htm, print date of Feb. 13, 2004, 1 page.

Artcobell, "Photos Music Chair," Internet Archive Wayback Machine, http://web.archive.org/web/20030702230829/www.artcobell.com/Uniflex+Unisled+Chairs/photos_music_chair.htm, Internet Archive Wayback Machine date of Jul. 2, 2003, 1 page.

Artcobell, "7109 Uniflex Music Chair," http://www.artcobell.com/uniflex.htm, print date of Feb. 13, 2004, 2 pages.

Artcobell, "Uniflex/Unisled Chairs," Internet Archive Wayback Machine, http://web.archive.org/web/20031210112600/www.artcobell.com/uniflex.htm, Internet Archive Wayback Machine date of Dec. 10, 2003, 46 pages.

Wenger, "A Chair That Helps Musicians Instead of Hindering Them,"1994, 6 pages.

Wenger, "Student Chair," 1997, 2 pages.

* cited by examiner

MUSIC POSTURE CHAIR

FIELD OF THE INVENTION

The present invention relates generally to a musician's chair. More particularly, the present invention relates to a musician's chair that enhances a musician's posture.

BACKGROUND OF THE INVENTION

For at least fifty years, it has been recognized that good posture enhances the performance of various activities. As a result, various products have been developed that enhance posture while performing various office, home and recreational activities.

For example, aeronautical and automotive seats have been developed that enable operators to comfortably operate their vehicles for extended periods of time. Spectator seating for cultural and sporting events have also been enhanced so that audiences can remain comfortably seated throughout the performances.

It can be appreciated that activities requiring higher levels of physical exertion have the potential of benefiting most from using equipment that promotes good posture as the posture tends to deteriorate as the body becomes more tired.

One particular field in which breathing is particularly important is for seated musicians such as the vocalist or wind instrumentalist. In light of the limitations associated with most prior art seating for musicians, it is common for the musicians to stand or sit near the front of a chair.

A drawback of these options is that it becomes difficult to remain standing or sitting near the front of a chair throughout an entire concert or practice session. As a result of the strains placed on the body when performing while standing or sitting on the front of the chair, the musician will typically be unable to maintain this position throughout the entire concert or practice session. When this occurs, the ability of the musician to remain focused on performing or practicing is greatly reduced.

One of the first attempts to produce a chair that promotes good posture while performing music is disclosed in Wenger et al., U.S. Pat. No. 4,306,750, which is assigned to the assignee of the present application. The Wenger et al. musicians' chair orients the back rest and seat to promote posture while performing music. While the Wenger chair had the potential of providing seated musicians with enhanced posture, these benefits were only fully realized when the musician properly sat in the Wenger chair.

SUMMARY OF THE INVENTION

The present invention is directed to a music posture chair having a frame, a seat and a back. The frame has a seat portion, a back portion and a plurality of legs. The seat is operably attached to the seat portion. The back is operably attached to the back portion.

The back is oriented with respect to the seat at an angle of between ninety and one hundred twenty degrees. The back has a deflection region proximate a lower edge thereof to enhance diaphragmatic breathing of a vocal or wind instrumentalist who is performing while sitting in the music posture chair.

DETAILED DESCRIPTION OF THE PREFERRED EMBODIMENTS

Figure 1:
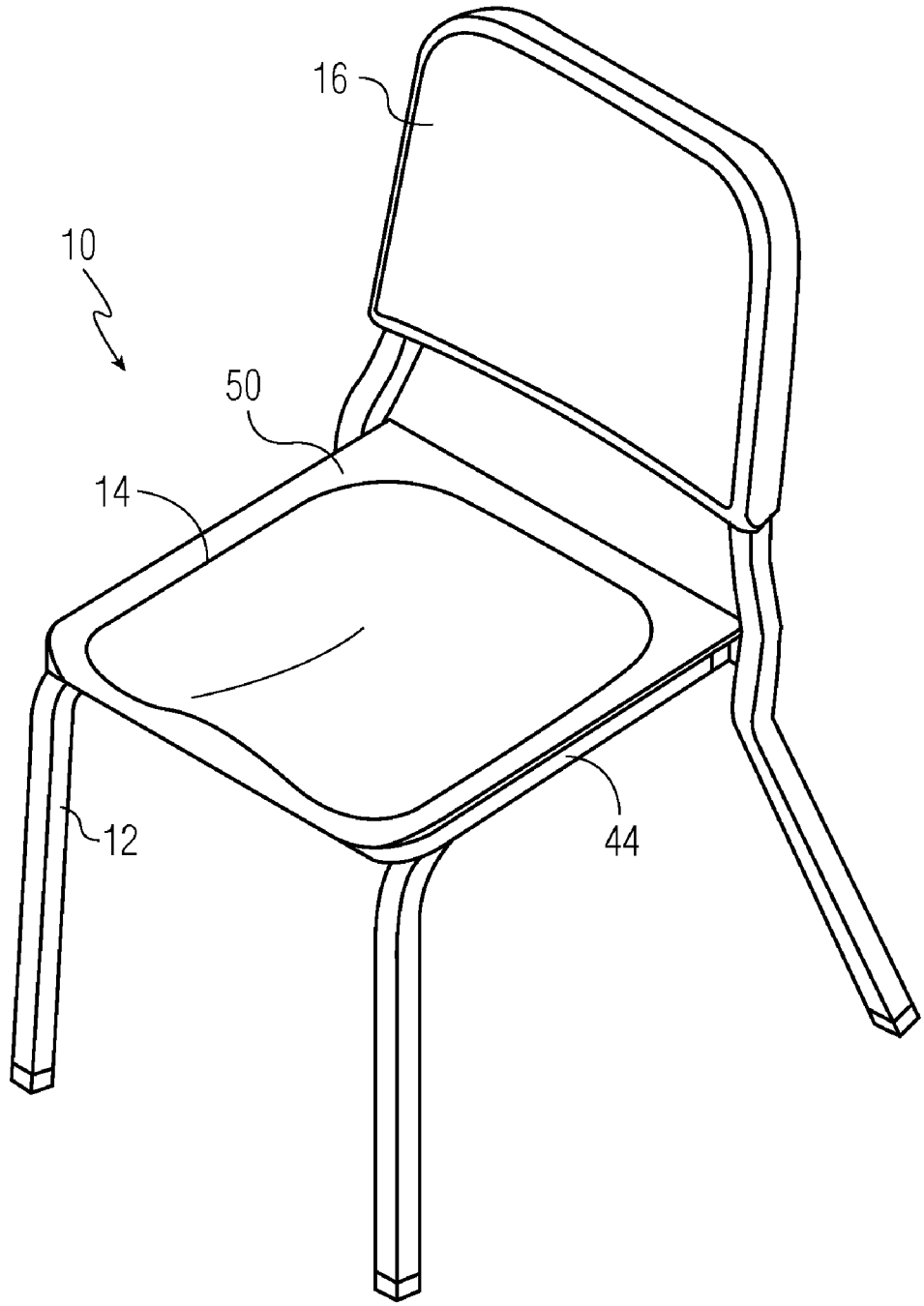
FIG. 1 is a perspective view of a music posture chair according to an embodiment of the present invention.
Figure 2:
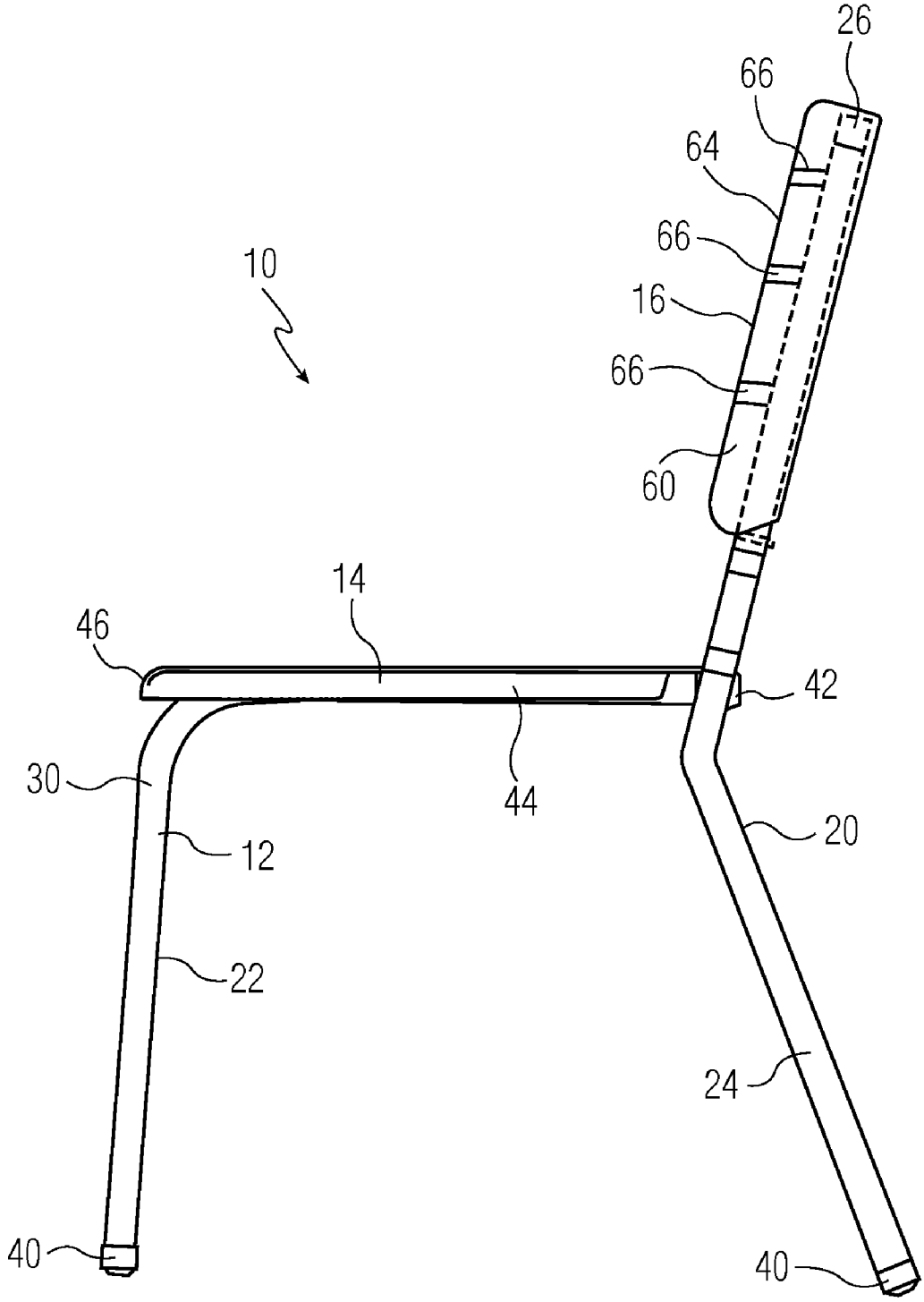
FIG. 2 is a side view of the music posture chair.
Figure 3:
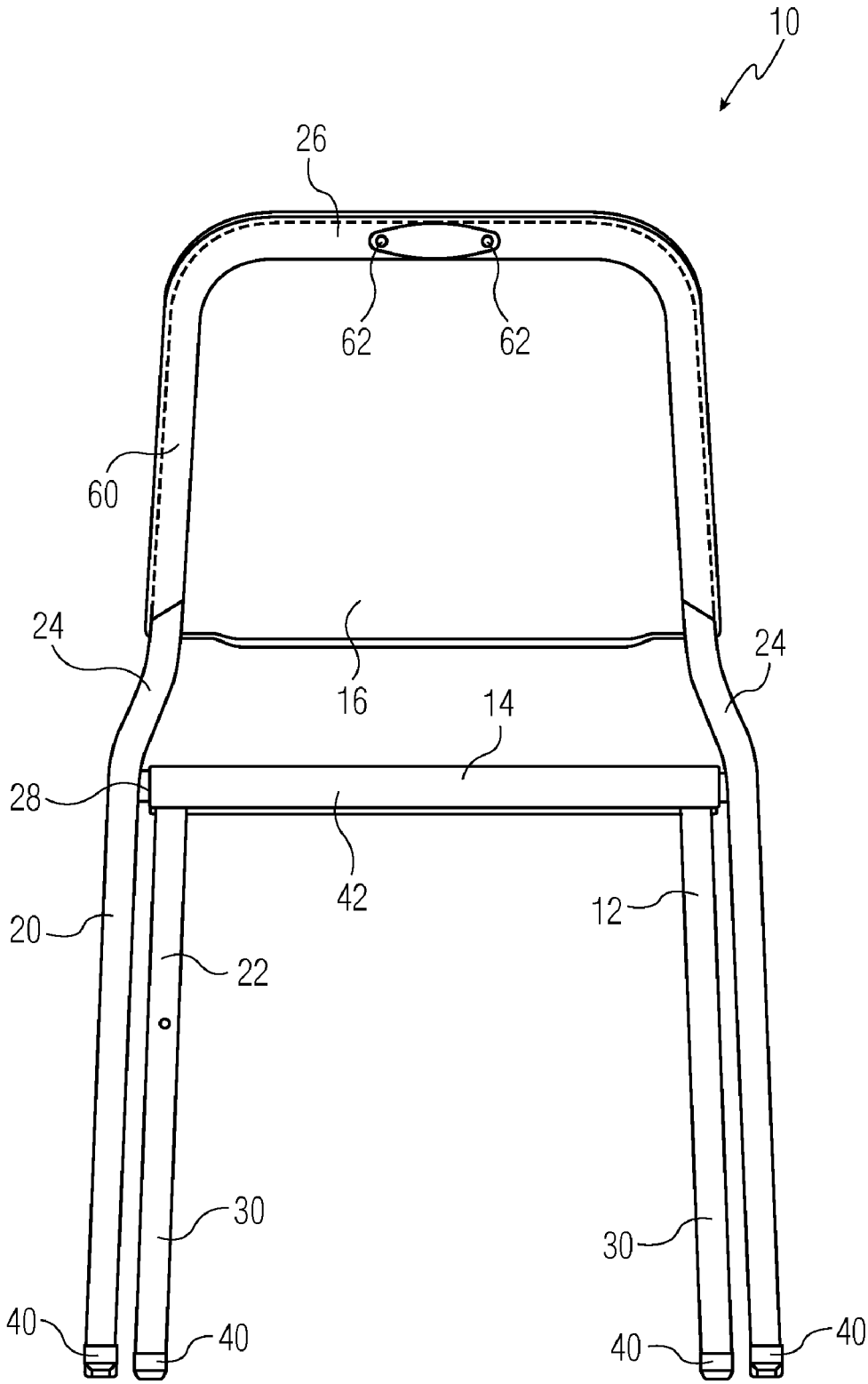
FIG. 3 is a back view of the music posture chair.
Figure 4:
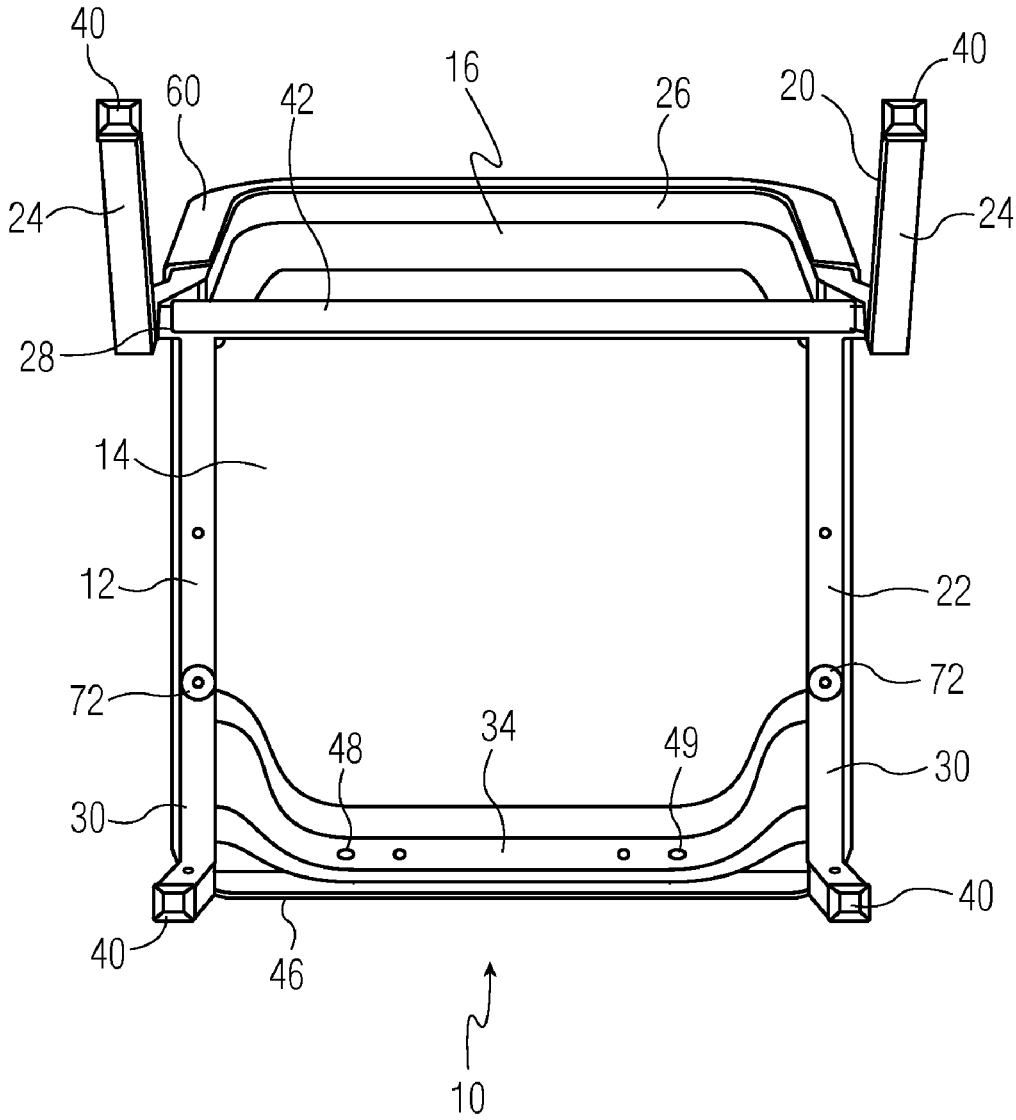
FIG. 4 is a bottom view of the music posture chair.

The present invention is music posture chair as illustrated at 10 in the Figures. The music posture chair 10 generally includes a frame 12, a seat 14, and a back 16.

The music posture chair 10 of the present invention positions the musician's torso and legs so that the musician sits in a good posture to free the diaphragm in a manner that is similar to standing and to promote extended comfort when performing while sitting in the music posture chair.

It is generally understood that the standing posture is the best natural body attitude that is conducive to a good musical performance where diaphragmatic breathing is required. Opera singers are a good example of the physiological demands endured in a vocal performance where quality musical sound must be projected to every seat in an auditorium without assistance of electronic amplification.

For a vocalist or wind instrumentalist to breathe properly, the lungs must be completely and quickly filled. To do this, the throat must be relaxed and fully opened and the lungs must be filled from the bottom.

To accomplish this type of breathing, the diaphragm should be pushed forward and down. It is only in this position that there is enough room for the lungs to expand fully meaning that the lungs should fill out sideways as well as downward.

To inhale properly, the diaphragm movement should be made first so that the lower part of the lungs fills first and the upper part of the lungs fills last. This procedure must happen in one continuous movement and the body and trunk should be upright and not slouched in any way.

In a normal standing posture, the spinal column takes a shape that forms what is called a "natural" or "relaxed" sacrolumbar curve. When this happens, the organs and upper body weight supported by the spine are in balance. This position tends to relax the muscles and permits the body to hold this position for long periods of time without discomfort caused when muscle tension occurs.

The standing posture, therefore, does two things for the performing musician: (1) it permits the diaphragm to function freely and (2) it releases the muscle tension that occurs when body weight carried by the spinal column is out of balance.

The natural sacro-lumbar curve can only occur in the seated posture when the body is forced to sit erect. If a performer sits on a horizontal surface without a back rest or leans back on a conventional chair with a back rest, the pelvis, which is generally perpendicular to the seat, tilts backward and Kyphosis of the lower spine occurs, which usually causes muscle fatigue after only an hour of sitting.

Therefore, many music instructors insist that students sit upright while playing regardless of the body posture suggested by the chair in which they are sitting. For the spinal column to assume a natural sacro-lumbar curve when the body is seated, a contoured seat is designed to rotate the pelvis forward is required.

Most musicians are required to perform in the seated posture for extended periods of time. Sitting for long periods creates another source of discomfort. If the buttocks and thighs are not properly supported, pressures build up in certain sensitive areas that can result in severe pain. These pressure points cause extreme discomfort if the seat contour is not designed to fit the shape of the musician's buttocks and upper thighs.

Most chairs are designed for home or office use and do not meet the needs of the seated performing musician. Consequently, the typical instrumentalist will be sitting in an upright posture on the front edge of a chair seat that is tilted to the rear. The back support is at such a reclining angle that the musician's back is normally six to twelve inches in front of it.

The music posture chair of the present invention is designed to meet the requirements of the performing musician. As discussed above, diaphragmatic breathing must be achieved in an open, free and unrestricted manner while the pelvis must be rotated forward and the body held erect to relieve muscle discomfort. The contour of the seat must be such that posterior discomfort is relieved. To achieve these objectives, a major emphasis is placed on the seat design and the relationship between the seat, the backrest and the floor.

To free the diaphragm for good breathing control, the portion of the seat that supports the thighs must be formed so that the thighs are slanted downward. This position frees the stomach muscles to "work" the diaphragm that, in turn, controls the pressure needed to sing or play a musical instrument. Therefore, the general plane of the thigh area of the seat is preferably sloped downwardly or slightly upwardly to open the angle between the torso and the thighs of the musician.

The height of the seat above the floor must be sufficient to maintain the thighs slanted downward with both feet flat on the floor. This configuration is not only important for diaphragmatic breathing but is also necessary to help balance the instrument and support the upper arms that are sometimes extended.

The frame 12 includes a back frame portion 20 and a front frame portion 22. The back frame portion 20 has two side bars 24, a top bar 26 and a back cross member 28. The top bar 26 extends between upper ends of the side bars 24 and is preferably formed from the same piece of tubing as the side bars 24.

The side bars 24 are preferably angled so that a lower end is behind an upper end. This configuration maintains the seat 14 and back 16 portions of the music posture chair 10 at a spaced apart distance when the music posture chair is placed adjacent to a wall.

The back cross member 28 extends between the side bars 24 intermediate upper and lower ends of the side bars 24. The back cross member 28 not only provides additional stability to the side bars 24 but also provide a location for attachment of the front frame portion 22 to the back frame portion 20.

The front frame portion 22 preferably includes two front legs 30 and a front cross member 34 that extends between the front legs 30. The front legs 30 are generally L-shaped and are attached to the back cross member 28. An upper section of the front legs 30 is preferably oriented substantially horizontal and a lower section of the front legs 30 is preferably oriented substantially vertical.

The front cross member 34 extends between the front legs 30 along the horizontally oriented section of the front legs 30 that is opposite the back cross member 28. The front cross member 34 thereby supports a front edge of the seat 14.

Lower ends of the side bars 24 and the front legs 30 each preferably include a glide 40 to enhance the ability of the music posture chair 10 to move along a ground surface without damaging the ground surface. The glides 40 preferably have a one-piece configuration and are made from a hard plastic material such as NYLON 66.

The components of the frame 12 are preferably fabricated from a metallic material to provide the frame 12 with a higher degree of durability and structural integrity.

The seat 14 extends over at least a portion of the back cross member 28, the front legs 30 and the front cross member 34. A back edge 42 of the seat 14 preferably has a U-shape to extend around the upper, back and lower sides of the back cross member 28.

Using this configuration enables the seat 14 to be maintained in a substantially stationary position with respect to the back cross member 28 without the use of fasteners. This configuration obviates the need for the use of protective pads or bumpers on the lower surface of the back cross member 28 when stacking the music posture chairs 10, as is described in more detail below.

Side edges 44 of the seat 14 extend over outer sides of the front legs 30. Using this configuration not only enhances the aesthetics of the music posture chair 10 by covering portions of the front legs 30 but also reduces the potential of the seat 14 from moving laterally with respect to the frame 12.

The side edges 44 may also extend around both the outer sides and lower sides of the front legs 30 to further reduce the potential of the seat 14 from moving laterally and vertically with respect to the frame 12.

The seat 14 is preferably attached to the front cross member 34 proximate a front edge 46 of the seat 14 using at least one fastener 48 such as a screw or rivet. Alternatively, the seat 14 may be configured to extend around at least a portion of the front cross member 34 to facilitate attachment of the seat 14 to the frame 12 without mechanical fasteners.

The seat 14 is preferably contoured to facilitate diaphragmatic breathing of the musician and to reduce posterior discomfort associated with sitting in the music posture chair 10. By minimizing posterior discomfort, the posture enhancement features of the present invention are further enhanced because when a person sitting in the music posture chair 10 begins to experience posterior discomfort, the person changes his/her position in the music posture chair 10 such as by moving away from the back 16.

A general plane of the seat 14 is generally parallel to the floor. This general plane relates to the portions of the seating surface 50 around the edges of the seat 14 upon which the performer does not sit. To free the diaphragm for good breath control, a portion of the seat 14 that supports the thighs is oriented so that the thighs are slanted downward.

This configuration frees the stomach muscles to "work" the diaphragm that, in turn, controls the pressure needed to sing or play a musical instrument. Therefore, a thigh support plane is sloped to open an angle between the torso and the thighs of the seated musician.

The height of the seat 14 above the floor is sufficiently high to maintain the thighs slanted downward with both feet flat on the floor. This configuration is not only important for diaphragmatic breathing but also helps to balance the instrument and support the upper arms that are sometimes extended as skillful arm movement is often necessary to create quality musical sound.

The seat 14 is preferably selected with a height to fit a large proportion of female and male body sizes that preferably range from the fifth to the ninety fifth percentiles. A seventeen and a half inch height seat height is suitable for most adults. A sixteen inch seat height is suitable for most elementary and middle school students. An eighteen and a half inch height may also be used to accommodate taller adults.

A width of the contoured portion of the seat 14 is preferably selected to accommodate the pelvic and thigh dimensions of a large proportion of female and male body sizes that preferably range from the fifth to the ninety fifth percentiles.

A center line of the thigh regions of the seat 14 is preferably about four inches from a center line of the seat 14. A length of the contoured portion of the seat 14 from back to front is preferably about sixteen inches to permit full back support and to enable the musician to place his/her feet flat on the floor.

In addition to the sloping plane of the thigh area, the seat 14 also preferably includes a generally upwardly sloping plane in the pelvis area. This pelvis plane rotates or tilts the pelvis forward and directs the spinal column into a flowing sacro-lumbar curve that will support the internal and external upper body in a balanced configuration.

Dimensions of the general plane for the pelvic area preferably are between three inches and six inches at the back of the seat 14 and preferably less than about two inches at the front of the seat 14.

This configuration is in contrast to posture chairs used for office or home applications that typically use bucket seats tilting to the rear with a back support contoured to match the shape of the correct sacro-lumbar dimensional range of the average adult population. While these features relieve long-term discomfort in work or home applications, they restrict good diaphragmatic breathing that is necessary for musicians.

The seat 14 is preferably contoured to eliminate pressure points by evenly distributing the upper body weight throughout the buttocks, hips and thighs. The seat 14 thereby eliminates pressure points that generate pain in the area of the ischial tubersities, under the thighs and in the area around the trochanters. The ischial tubersities are the sitting bones centered on each buttock and the trochanters are the outermost projections of the hips.

The back 16 is attached to the frame along side and upper surfaces thereof. The back 16 preferably includes an edge 60 that extends around an outer surface and a back surface of the side bars 24 and the top bar 26. While it is possible for the edge 60 to also extend an inner surface of the side bars and/or the top bars 26 to facilitate attachment of the back 16 to the frame 12 without fasteners and to protect the back frame and to present a more finished appearance, at least one fastener 62 is preferably extended through the edge 60 and into the top bar 26 proximate a center of the top bar 26.

A front surface 64 of the back 16 is preferably spaced a distance away from a front surface of the side bars 24 and the top bar 26 using a plurality of spacers 66. Maintaining the front surface 64 away from the front surfaces of the side bars 24 and the top bar 26 and not using a lower frame member across the bottom of the back 16 enables the back 16 to deflect when a person leans against the back 16.

The deflection also enhances the ability of the music posture chair 10 to conform to a vertical sacro-lumbar curve. This deflection allows the back 16 to better conform to a back of a person using the music posture chair 10 to not only reduce pressure points but also to facilitate enhanced diaphragmatic breathing when compared to the music posture chair set forth in U.S. Pat. No. 4,306,750, which is described in more detail above.

The back 16 contributes to the diaphragmatic breathing as well as the comfort of the music posture chair 10. An angle between the seat 14 and the back 16 is more than ninety degrees to free the diaphragm. This angle in combination with the angle of the thigh areas accommodates foot and leg resistance when the musician is exerting muscle pressure against the diaphragm. While the angle between the seat 14 and the back 16 can range from ninety to one hundred twenty degrees, it is preferably one hundred three degrees.

The seat 14 and the back 16 are preferably fabricated from a material such as polypropylene that is durable while providing a warm, soft touch. If padding is used on the seat 14 or the back 16, the seat 14 and the back 16 remain in the desired orientation with respect to each other to promote optimum posture. If foam padding is used, a high quality foam designed to hold its shape for many years of constant use should be chosen. If an upholstered version is preferred, a high abrasion resistant fabric should be used.

Figure 5:
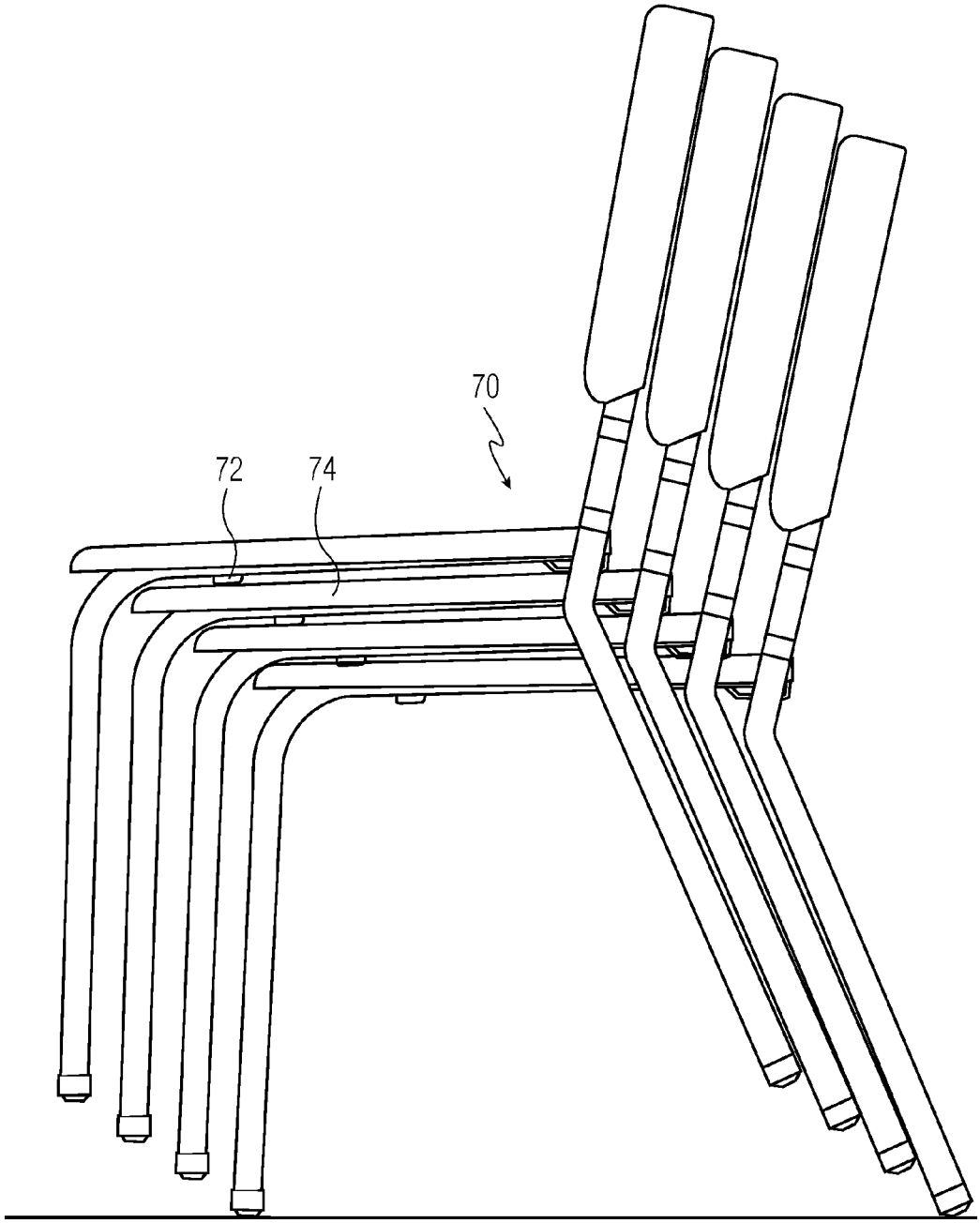
FIG. 5 PRIOR ART
FIG. 5 is a side view of a stack of prior art chairs.
Figure 6:
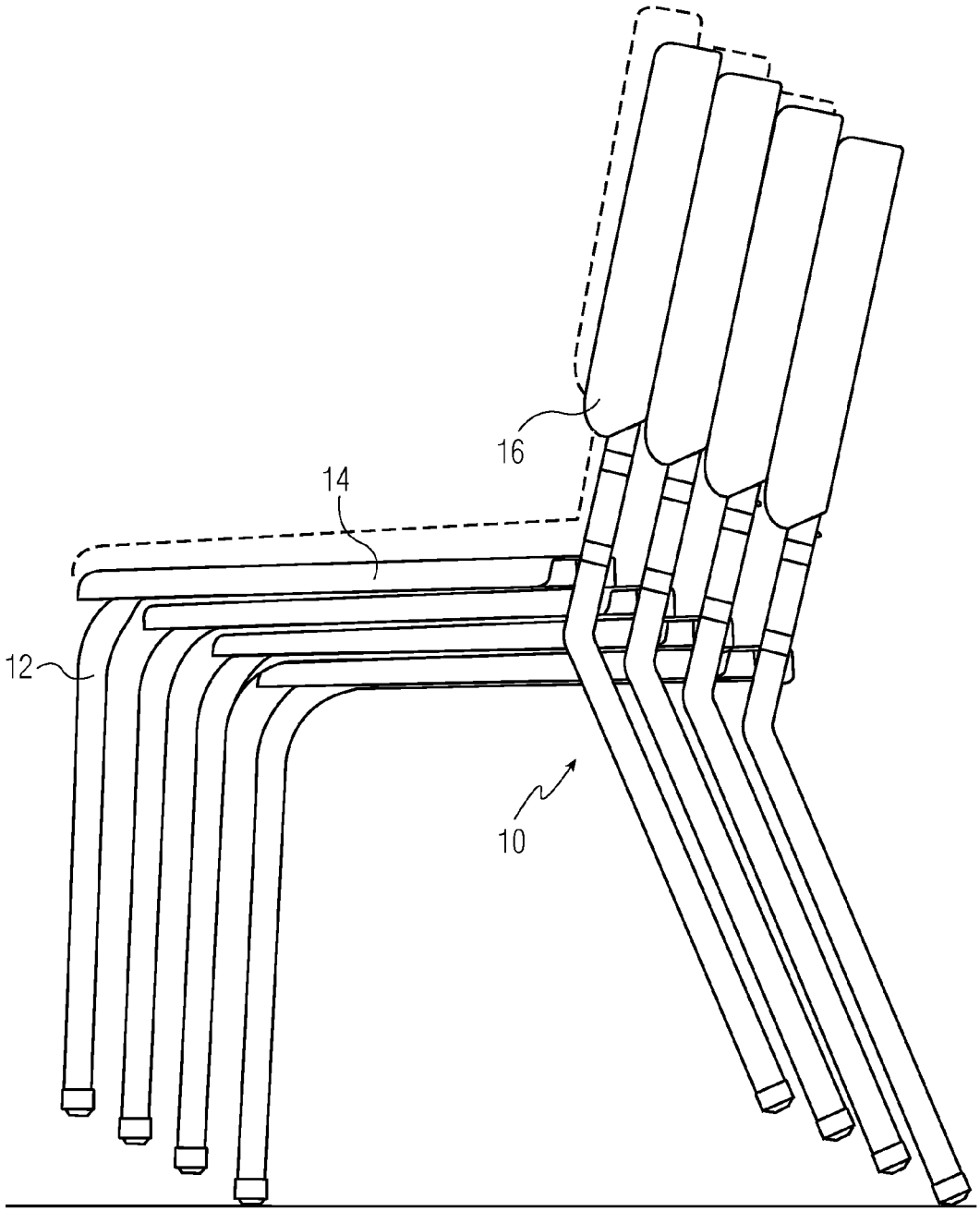
FIG. 6 is a side view of a stack of music posture chairs according to the present invention.
Figure 7:
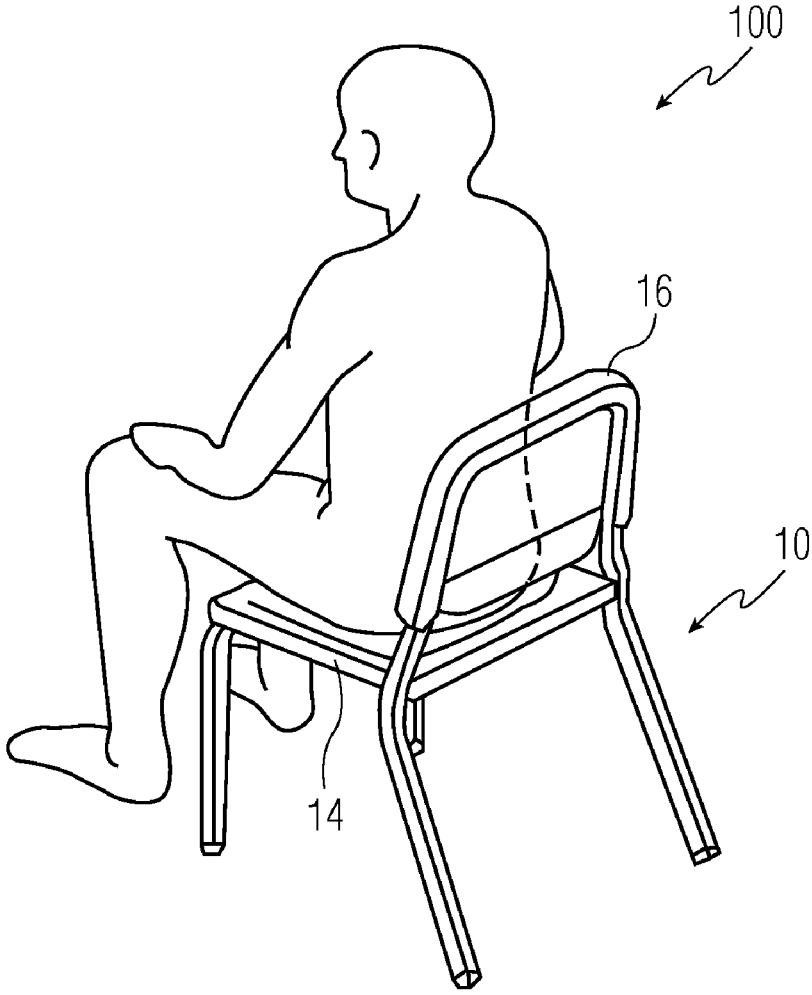
FIG. 7 is a perspective view of the person sitting in the music posture chair.
Figure 8:
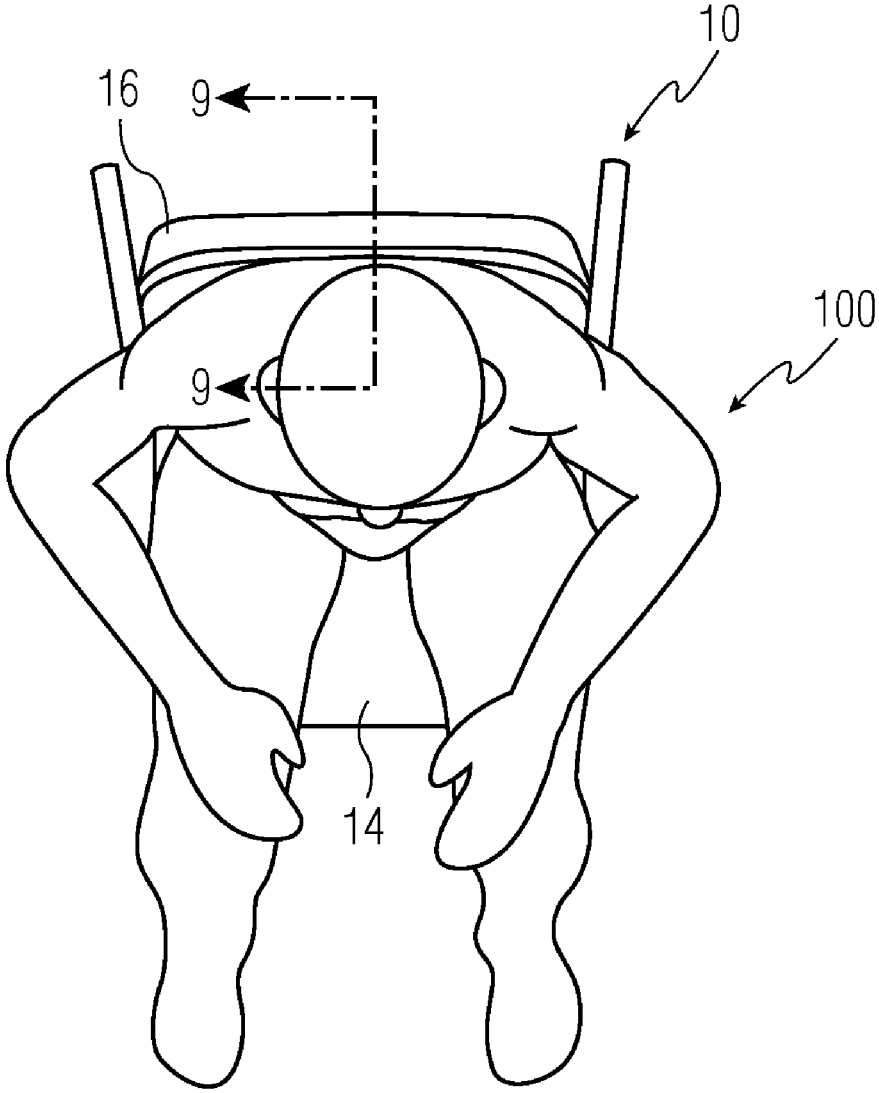
FIG. 8 is a top view of a person sitting in the music posture chair.

In many situations, chairs used for music performances or practices are stacked when not in use, such as is illustrated in FIGS. 5 and 6. To reduce the potential of damage to stacked music chairs 70, it is typical to place bumpers 72 on portions of the lower frame surface to thereby reduce or eliminate contact of the frame with upper seat surfaces 74 of a lower chair in the stack.

The music posture chair 10 of the present invention reduces the need for bumpers because the seat 12 extends around the back and lower edges of the back cross member 28 to thereby prevent contact between the upper surface of the seat 12 and the lower surface of the back cross member 28 when the music posture chairs 10 are stacked.

Extending a portion of the seat 14 over the lower surface of the front cross member 34 and/or over the lower surfaces of the front legs 30 could also obviate the need for bumpers proximate the front of the music posture chair 10.

Figure 9:
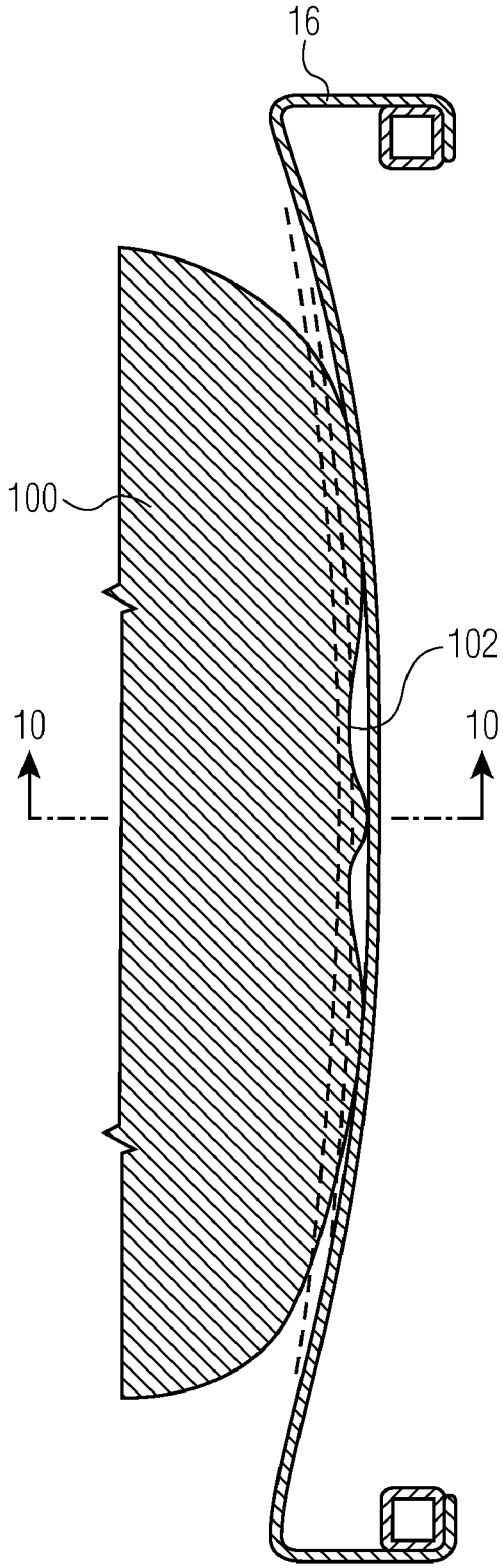
FIG. 9 is a sectional view of the person sitting in the music posture chair taken along a line 9-9 in FIG. 8.
Figure 10:
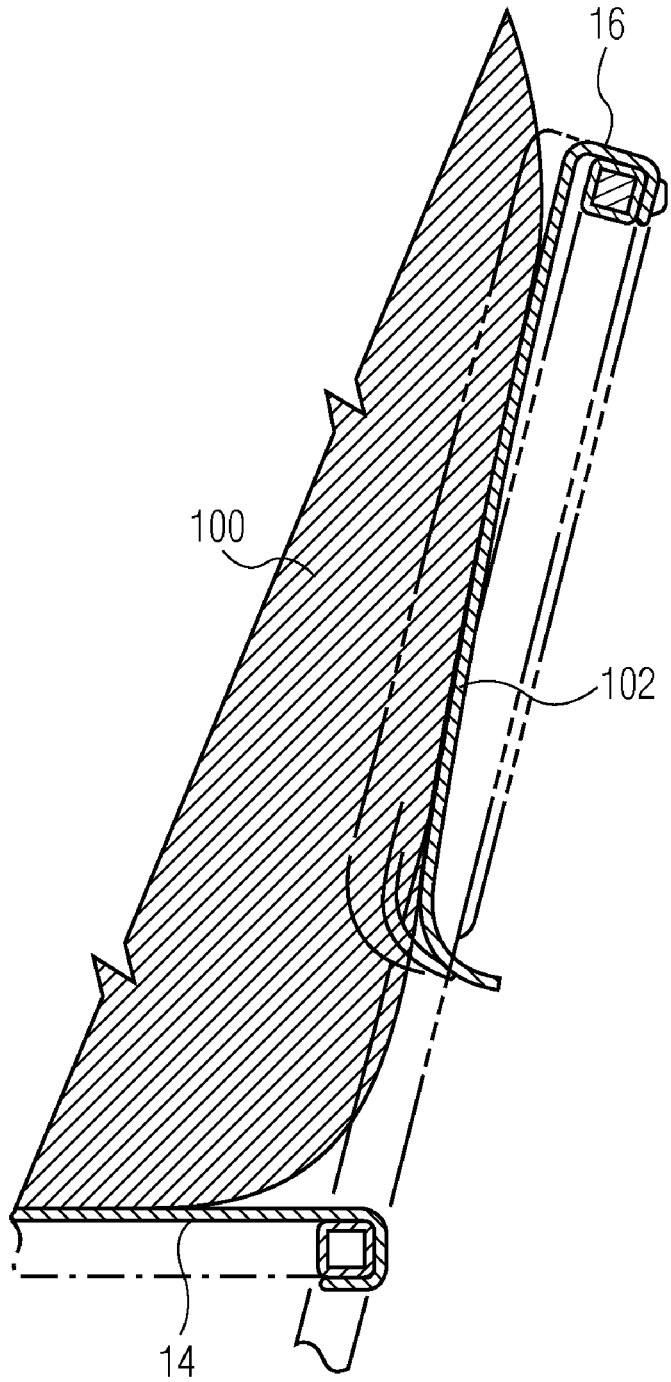
FIG. 10 is a sectional view of the person sitting in the music posture chair taken along a line 10-10 in FIG. 9.

In operation, a musician 100 sits in the music posture chair 10, as illustrated in FIGS. 7-10. The musician's pelvis and thighs are on the seat 14. Initially, the musician's back 102 only contacts the back 16 along a lower edge thereof, as illustrated in FIGS. 9 and 10.

Figure 11:
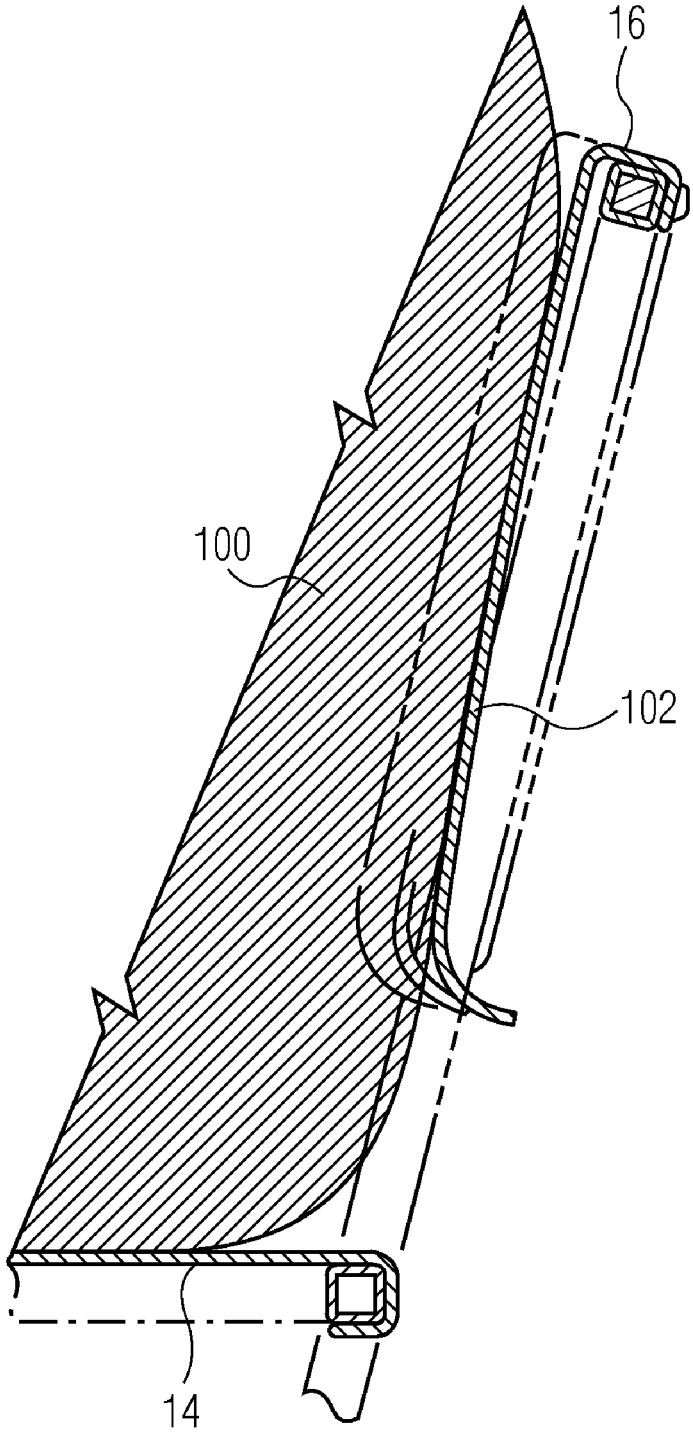
FIG. 11 is a sectional view of the person sitting in the music posture chair after a back portion of the chair has been deflected.

In response to pressure from the musician's back 102, the back 16 is moved to a deflected position, as illustrated in FIG. 11. By moving to the deflected position, an area over which the musician's back 102 contacts the back 16 is significantly increased to extend from the lower edge to proximate an upper edge.

The increased contact area reduces pressure points on the musician's back 102 and thereby enhances the extended comfort when using the music posture chair 10. Selective deflection of the back 16 also enhances the ability of the musician to experience diaphragmatic breathing.

Figure 12:
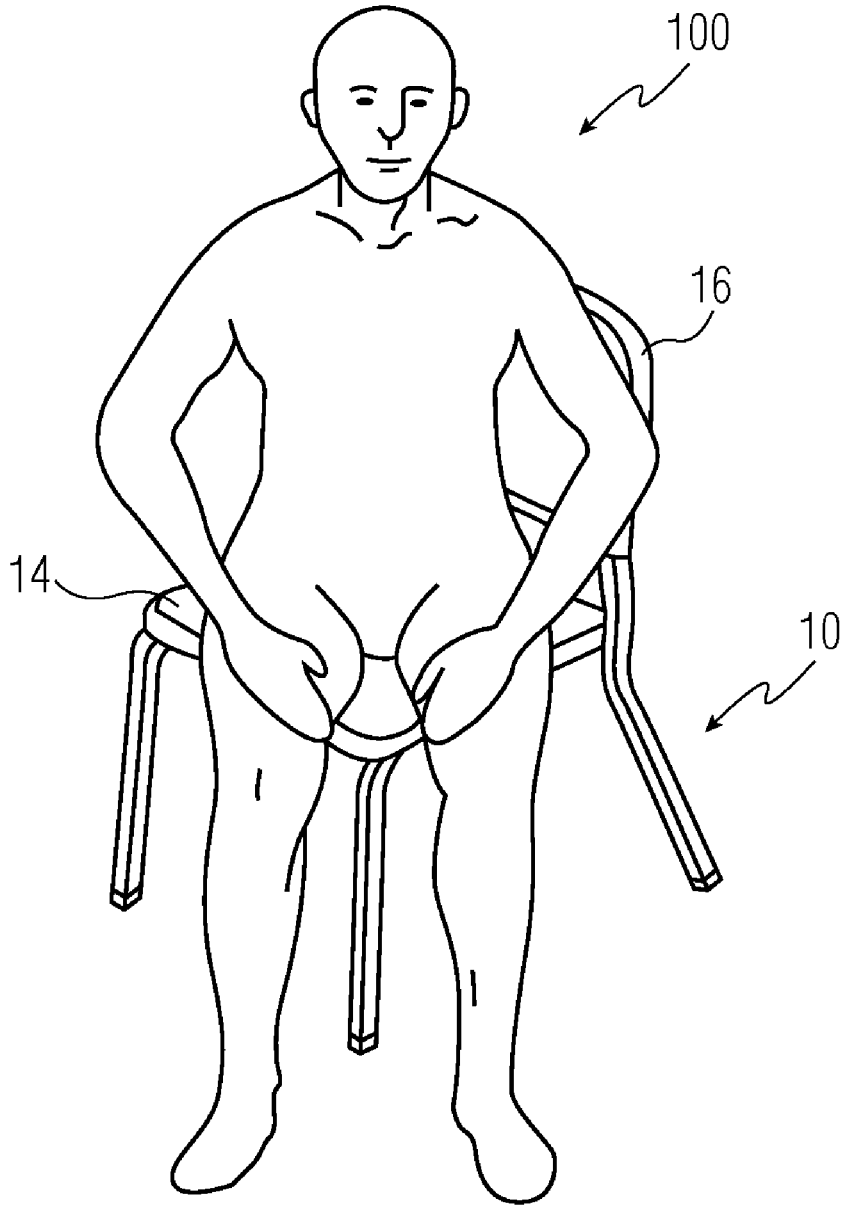
FIG. 12 is a perspective view of a person sitting in an alternative position on the music posture chair.
Figure 13:
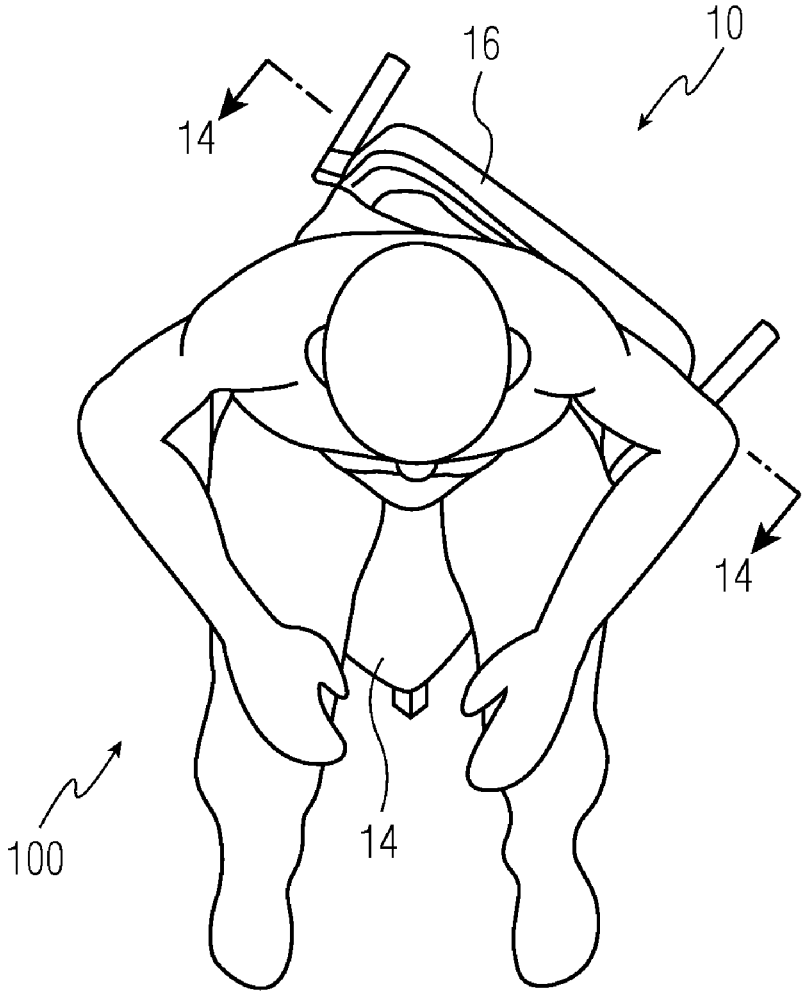
FIG. 13 is a top view of the person sitting in the alternate position on the music posture chair.
Figure 14:
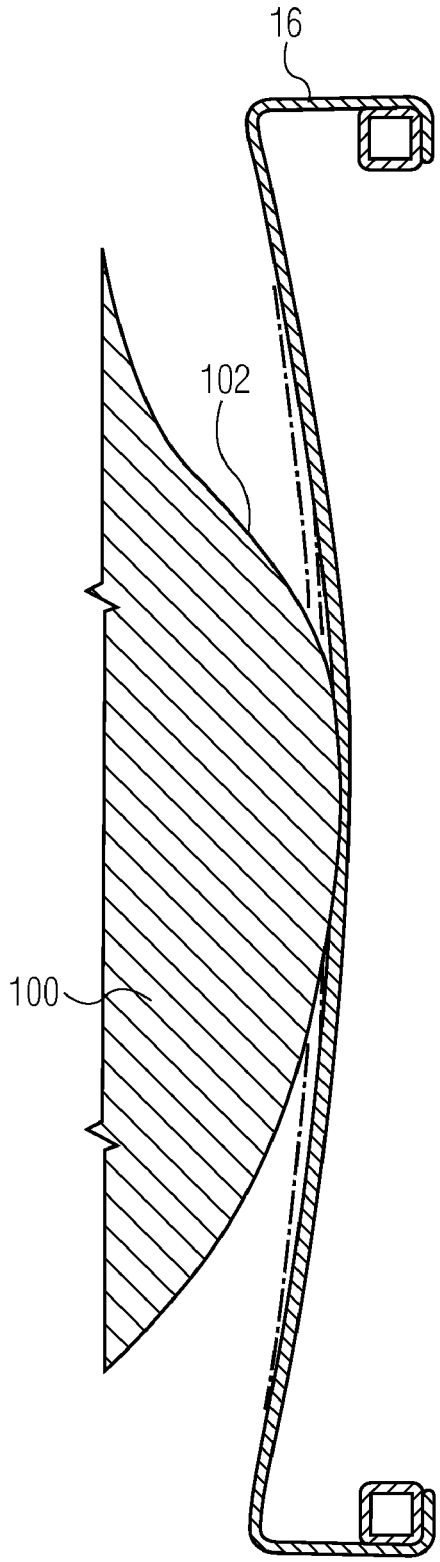
FIG. 14 is a sectional view of the person sitting in the alternate position on the music posture chair taken along a line 14-14 in FIG. 13.

The music posture chair 10 of the present invention also offers benefits when the musician 100 sits on the music posture chair 10 at an angle, as illustrated in FIGS. 12-14. When the musician 100 is sitting in this orientation, the area over which the musician's back 102 contacts the back 16 is significantly reduced when compared to the straight on orientation illustrated in FIGS. 7-11, which often leads to increased pressure points that result in greater discomfort for the musician 100.

The back 16 deflects, as illustrated in FIG. 14, to thereby increase the vertical surface area over which the musician's back 102 contacts the back 16. Even though this sitting orientation results in a rather narrow contact width between the musician's back 102 and the back 16, the enhanced vertical contact area reduces the potential of the musician 100 to experience discomfort resulting from extended periods of sitting on the music posture chair 10 in this orientation.

This orientation thereby illustrates that the enhanced comfort and diaphragmatic breathing benefits of the music posture chair 10 of the present invention can be realized whether or not the musician 100 is sitting in the straight on orientation on the music posture chair 10.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A music posture chair comprising:

a frame having i) a seat portion, ii) a back portion, the back portion comprising two side rails and a top rail extending between the two side rails, and iii) a plurality of legs;

a seat operably attached to the seat portion; and a back operably attached to the side rails and the top rail of the back portion, wherein the back is oriented with respect to the seat at an angle of between ninety and one hundred twenty degrees, wherein the back has a deflection region proximate a lower edge thereof to enhance diaphragmatic breathing of a vocal or wind musician who is performing while sitting in the music posture chair, wherein the back includes an edge that extends around at least a portion of an outer side surface and a back surface of the back portion, and wherein the back includes at least one spacer that maintains the back a selected distance from a front surface of the back portion.

2. The music posture chair of claim 1, wherein the deflection region extends substantially between opposite sides of the back proximate a lower portion of the back.

3. The music posture chair of claim 1, wherein the back is oriented with respect to the seat at an angle of about one hundred three degrees.

4. The music posture chair of claim 1, wherein the seat includes two laterally spaced apart thigh support planes that are each oriented at an angle of between about three degrees above horizontal to ten degrees below horizontal from back to front.

5. The music posture chair of claim 4, wherein the seat includes a pelvis support plane lying along a longitudinal center line of the seat.

6. The music posture chair of claim 5, wherein the thigh support planes and the pelvis support plane are contoured to redistribute the musician's weight throughout the buttock and thigh area.

7. The music posture chair of claim 5, wherein a back of the musician is positioned relative to the pelvis support plane in a natural and relaxed sacro-lumbar curve so that upper body weight supported by a musician's spine are in balance.

8. A music posture chair comprising:

a frame having i) a seat portion, ii) a back portion, the back portion comprising two side rails and a top rail extending between the two side rails, and iii) a plurality of legs;

a seat operably attached to the seat portion; and a back attached to the side rails and the top rail of the back portion and comprising:

a central region having an upper edge, a lower edge and a pair of side edges that each extend between the upper edge and the lower edge;

an end panel that extends along at least a portion of the upper edge and the side edges and at least partially surrounding the side rails and top rails of the back portion;

a spacer that maintains the central region in a spaced-apart relationship with respect to the side rails and the top rail of the back portion; and a deflection region proximate the lower edge that extends substantially between the side edges.

9. The music posture chair of claim 8, wherein the back is oriented with respect to the seat at an angle of about one hundred three degrees.

10. The music posture chair of claim 8, wherein the seat includes two laterally spaced apart thigh support planes that are each oriented at an angle of between about three degrees above horizontal to ten degrees below horizontal from back to front.

11. The music posture chair of claim 10, wherein the seat includes a pelvis support plane lying along a longitudinal center line of the seat.

12. The music posture chair of claim 11, wherein the thigh support planes and the pelvis support plane are contoured to redistribute a musician's weight throughout buttock and thigh areas.

13. The music posture chair of claim 11, wherein a torso of a musician is positioned relative to the pelvis support plane in a natural and relaxed sacro-lumbar curve so that upper body weight supported by the musician's spine is in balance.

14. A method of supporting a vocal or wind musician who is performing while seated, the method comprising:

providing a chair having a frame having i) a seat portion, ii) a back portion, the back portion comprising two side rails and a top rail extending between the two side rails, and iii) a plurality of legs;

a seat operably attached to the seat portion; and a back attached to the side rails and the top rail of the back portion and comprising:

a central region having an upper edge, a lower edge and a pair of side edges that each extend between the upper edge and the lower edge;

an end panel that extends along at least a portion of the upper edge and the side edges and at least partially surrounding the side rails and top rails of the back portion;

a spacer that maintains the central region in a spaced-apart relationship with respect to the side rails and the top rail of the back portion; and a deflection region proximate the lower edge that extends substantially between the side edges;

supporting the musician's thighs and pelvis with the seat;

distributing the musician's weight across the seat to eliminate pressure points;

orienting the musician's pelvis with respect to the musician's torso in a natural and relaxed sacro-lumbar curve so that upper body weight supported by the musician's spine are in balance; and deflecting a lower portion of the back in response to pressure from the musician's torso on the deflection region to provide the musician with proper diaphragmatic breathing.

15. The method of claim 14, wherein the back includes an edge that extends around at least a portion of an outer side surface and a back surface of the back portion.

16. The method of claim 15, and further comprising maintaining the back a selected distance from a front surface of the back portion with at least one spacer.

17. The method of claim 16, wherein the deflection region extends substantially between opposite sides of the back proximate a lower portion of the back.

18. The method of claim 14, and further comprising orienting the back with respect to the seat at an angle of about one hundred three degrees.

19. The method of claim 14, wherein the seat includes two laterally spaced apart thigh support planes that are each oriented at an angle of between about three degrees above horizontal to ten degrees below horizontal from back to front.

20. The method of claim 19, wherein the seat includes a pelvis support plane lying along a longitudinal center line of the seat.

21. The method of claim 20, wherein the thigh support planes and the pelvis support plane are contoured to redistribute the musician's weight throughout the buttock and thigh area.

22. The method of claim 20, wherein a back of the musician is positioned relative to the pelvis support plane in a natural and relaxed sacro-lumbar curve so that upper body weight supported by the musician's spine is in balance.

23. A music posture chair for a performing musician comprising:

a frame having a seat portion, a back portion and a plurality of legs, wherein the back portion comprises a pair of side rails and a top rail that extends between the side rails, wherein the seat portion extends from the back portion, and wherein the plurality of legs support the seat portion and the back portion above a ground surface;

a seat attached to the seat portion, wherein the height of the chair seat permits the musician to have both feet flat on the floor, and wherein the chair seat comprises:

two thigh support planes that are each oriented at an angle of between about three degrees above horizontal to ten degrees below horizontal from back to front and in combination with the height of the chair seat causes the thighs of the musician to slant downward toward the floor to open the angle between the abdomen and legs of the musician to enhance diaphragmatic breathing; and a central support area forming a pelvis support plane comprising an area lying along a longitudinal center line of the seat;

a back attached to the side rails and the top rail of the back portion and comprising:

a central region having an upper edge, a lower edge and a pair of side edges that each extend between the upper edge and the lower edge;

an end panel that extends along at least a portion of the upper edge and the side edges and at least partially surrounding the side rails and top rails of the back portion;

a spacer that maintains the central region in a spaced-apart relationship with respect to the side rails and the top rail of the back portion; and a deflection region proximate the lower edge that extends substantially between the side edges and the back positioned so that a center line of the back intersects the thigh support plane at an angle within the range of ninety degrees to one hundred twenty-five degrees and intersects the pelvis support plane at a back edge of the pelvis support plane so that the back of the musician is precisely positioned relative to the pelvis support plane in a natural and relaxed sacro-lumbar curve so that the organs and upper body weight supported by the spine of the performer are in balance, and wherein the back comprises a deflection region that deflects in response to force from the musician's back to enhance the ability of the musician to experience diaphragmatic breathing.

24. The music posture chair of claim 23, wherein the chair seat has a back edge and a front edge and wherein the slope of the pelvis support plane is at an angle of about six degrees above horizontal from back to front.

25. The music posture chair of claim 23, wherein the angle of the backrest to the pelvis support plane is at an angle of between about ninety degrees to one hundred eighteen degrees.

26. The music posture chair of claim 23, wherein the chair seat has a back edge and a front edge and wherein the pelvis support plane is at an angle of between about twenty degrees to three degrees above the thigh support plane from back to front.

27. The music posture chair of claim 23, wherein the pelvis support plane is at an angle of about three degrees above the thigh support plane.

28. The music posture chair of claim 23, wherein the height of the seat is within the range of sixteen and a half inches to eighteen and a half inches.

29. The music posture chair of claim 23, wherein the thigh support plane and the pelvis support plane are contoured to redistribute the weight of the musician throughout the buttock and thigh area.

* * * * *